US006805249B1

(12) United States Patent
Houle

(10) Patent No.: US 6,805,249 B1
(45) Date of Patent: Oct. 19, 2004

(54) CD DISPLAY RACK

(76) Inventor: Andre Houle, 49 McKinstry Ave., Chicopee, MA (US) 01013

( * ) Notice: Subject to any disclaimer, the term of this patent is extended or adjusted under 35 U.S.C. 154(b) by 0 days.

(21) Appl. No.: 10/265,524

(22) Filed: Oct. 7, 2002

(51) Int. Cl.[7] ..... A47F 7/00

(52) U.S. Cl. ..... 211/40; 211/55; D6/407; 248/457; 248/465

(58) Field of Search ..... 211/40, 41.12, 211/50, 55; 40/124; 248/457, 463, 455, 456, 465; D6/407, 630

(56) References Cited

U.S. PATENT DOCUMENTS

| | | | | | |
|---|---|---|---|---|---|
| 243,407 | A | * | 6/1881 | Shedlock | |
| 425,306 | A | * | 4/1890 | Dawdy | |
| 751,892 | A | * | 2/1904 | Andre | |
| 1,203,659 | A | * | 11/1916 | Smith | |
| 1,261,195 | A | * | 4/1918 | Venable | |
| 1,850,647 | A | * | 3/1932 | Whitcomb | |
| 2,041,017 | A | * | 5/1936 | Pennington | |
| 2,249,663 | A | * | 7/1941 | Minnick | |
| 2,356,036 | A | * | 8/1944 | Dreisbach | |
| 2,518,877 | A | * | 8/1950 | Gauff | |
| 3,486,634 | A | * | 12/1969 | Frater | |
| 4,676,372 | A | * | 6/1987 | Rager | 211/40 X |
| 4,739,960 | A | * | 4/1988 | Adler | 248/465 X |
| 4,940,147 | A | | 7/1990 | Hunt | 211/40 |
| 5,040,687 | A | | 8/1991 | Whittington | 211/40 |
| 5,234,190 | A | * | 8/1993 | Cross | 248/465 X |
| D356,454 | S | * | 3/1995 | Harris | D6/407 |
| 5,462,177 | A | | 10/1995 | O'Donnell | 211/40 |
| D413,754 | S | | 9/1999 | Houle | D6/630 |
| D425,748 | S | | 5/2000 | Houle | D6/630 |

* cited by examiner

*Primary Examiner*—Robert W. Gibson, Jr.
(74) *Attorney, Agent, or Firm*—Sturm & Fix LLP

(57) ABSTRACT

A display rack (10) for CDs including an elongated tapered primary support member (20) having an angled front face (21) provided with a plurality of vertically staggered narrow shelves (22) and a rear face (25) provided with an enlarged recess (26) dimensioned to receive a support panel member (30) pivotally suspended within the enlarged recess (26) wherein, the support panel member (30) extends below the upwardly angled contoured rear portion (24") of the bottom (24) of the primary support member (20) wherein the support panel member (30) can be extended to provide a means of support on a horizontal surface or retracted to allow suspension on a vertical surface.

17 Claims, 2 Drawing Sheets

CD DISPLAY RACK

BACKGROUND OF THE INVENTION

CROSS REFERENCE TO RELATED APPLICATIONS

Not applicable.

FIELD OF THE INVENTION

The present invention relates to the field of display rack constructions in general and in particular to a display rack that is specifically designed and dimensioned to display compact discs.

DESCRIPTION OF RELATED ART

As can be seen by reference to the following U.S. Pat. Nos. 4,940,147; 5,462,177; 5,040,687; Des. 425,748; and Des. 413,754, the prior art is replete with myriad and diverse display rack constructions.

While all of the aforementioned prior art constructions are more than adequate for the basic purpose and function for which they have been specifically designed, they are uniformly deficient with respect to their failure to provide a simple, efficient, and practical display rack for compact discs or CDs that is equally suited to being supported on a horizontal surface or a vertical surface and which provides an aesthetically pleasing appearance in either mode of disposition.

Unfortunately, up until the present time, the prior art has failed to incorporate the dual functionality of the present invention into any type of CD display rack no less one as appealing to the eye as the various embodiments of the present invention.

As a consequence of the foregoing situation, there has existed a longstanding need among owners of CDs for a new and improved display rack that is eminently practical and pleasing to look at, as well as, one that is equally at home on a variety of horizontal and vertical surfaces; and the provision of such a display rack is the stated objective of the present invention.

BRIEF SUMMARY OF THE INVENTION

Briefly stated, the display rack structure that forms the basis of the present invention comprises in general a primary support unit and an auxiliary support unit that is pivotally connected to the primary support unit to function as a support means of the primary support unit on a horizontal surface when extended, or to be retracted within the primary support unit so that the primary support unit can be suspended in a flush fashion against a vertical wall surface.

As will be explained in greater detail further on in the specification, the primary support unit comprises in general an enlarged tapered primary support member having an angled front face provided with a plurality of vertically staggered narrow shelves for supporting a plurality of CDs, a contoured bottom having a generally flat narrow front portion, an upwardly angled contoured rear portion, and a rear face provided with an enlarged recess dimensioned to receive the auxiliary support unit.

In addition, the auxiliary support unit includes a support panel member having a rearwardly angled top and a front having a rearwardly angled upper portion; wherein, the support panel member is pivotally suspended within the enlarged recess in the primary support member so that the trailing edge of the angled top of the support panel member will engage the top of the enlarged recess to limit the pivotal movement of the support panel member relative to the primary support member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
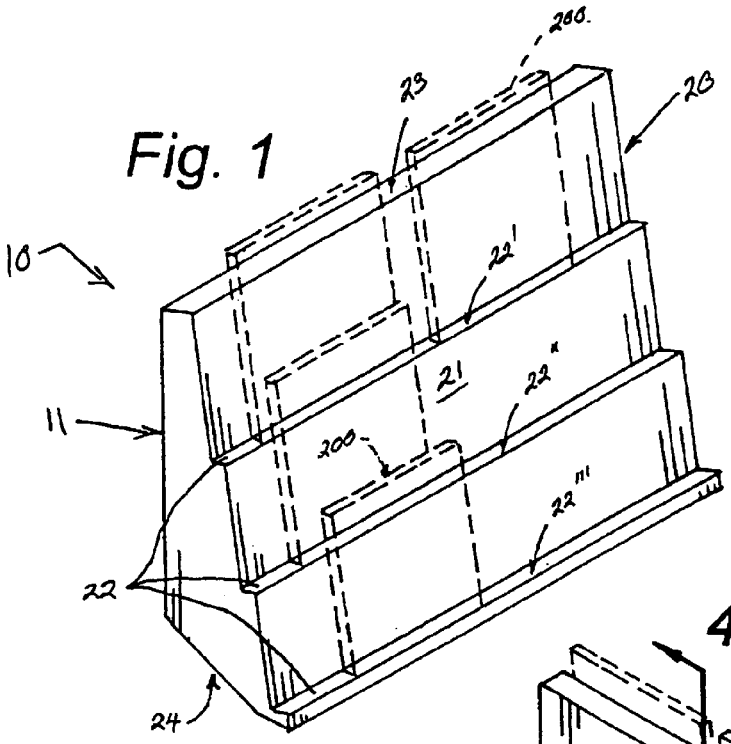
FIG. 1 is a front perspective view of a first version of the preferred embodiment of the improved CD display rack that forms the basis of this invention.
Figure 2:
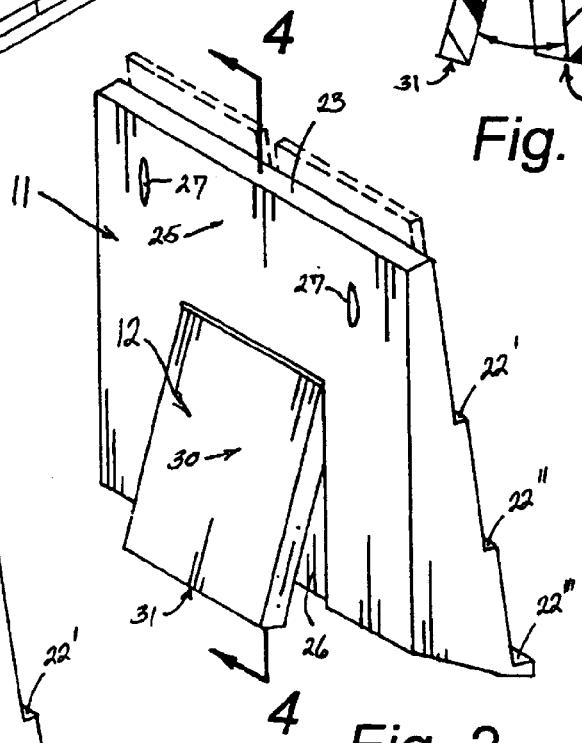
FIG. 2 is a rear perspective view of the first version of the preferred embodiment.

As can be seen by reference to the drawings, and in particular to FIGS. 1 and 2, the improved CD display rack that forms the basis of the present invention is designated generally by the reference number 10. The display rack 10 comprises in general a primary support unit 11 and an auxiliary support unit 12. These units will now be described in seriatim fashion.

In the first version of the preferred embodiment depicted in FIGS. 1 through 6, the primary support unit 11 comprises an enlarged generally tapered primary support member 20 having an angled front face 21 provided with a plurality of vertically staggered narrow depth shelves 22 which extend entirely across the angled front face and including an upper shelf 22' at least one intermediate shelf 22" and a bottom shelf 22'"; wherein, the upper shelf 22' is spaced from the generally flat top surface 23 of the primary support member 20 and the bottom shelf 22'" is disposed proximate to, but spaced from, the contoured bottom surface 24 of the primary support member 20.

As can best be appreciated by reference to FIGS. 2 through 5, the primary support member 20 is further provided with a substantially flat rear face 25 having an enlarged generally rectangular recess 26 formed therein and dimensioned to at least substantially receive the auxiliary support unit 12 as will be explained in greater detail further on in the specification.

Figure 6:
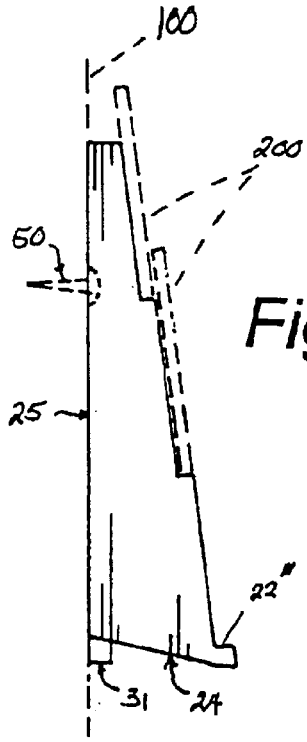
FIG. 6 is a side plan view of the CD display rack mounted on a vertical wall surface.
Figure 7:
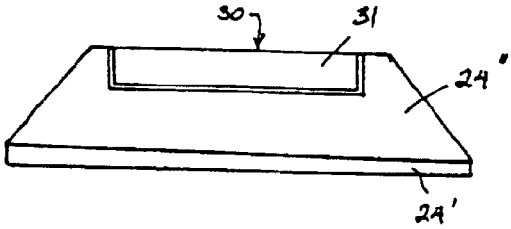
FIGS. 7 through 10 are bottom plan views showing alternate configurations for the angled bottom portions of the CD display rack.
Figure 8:
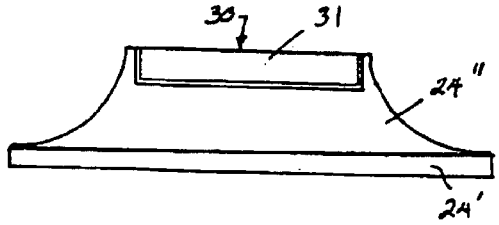
Figure 9:
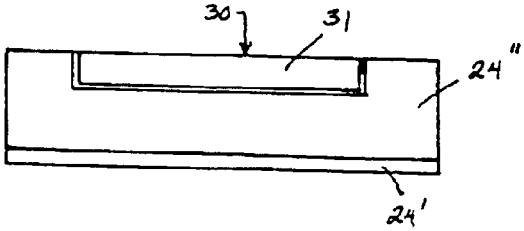
Figure 10:
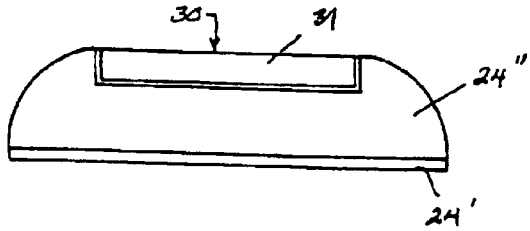

In addition, as shown in FIGS. 2 and 6, the rear face 25 of the primary support member 20 is further provided with a plurality of relatively narrow mounting slots 27 that are adapted to receive conventional fasteners 50 such as nails, picture hooks, etc., for mounting the primary support member 20 to a vertical wall surface 100 in a well recognized fashion.

Figure 4:
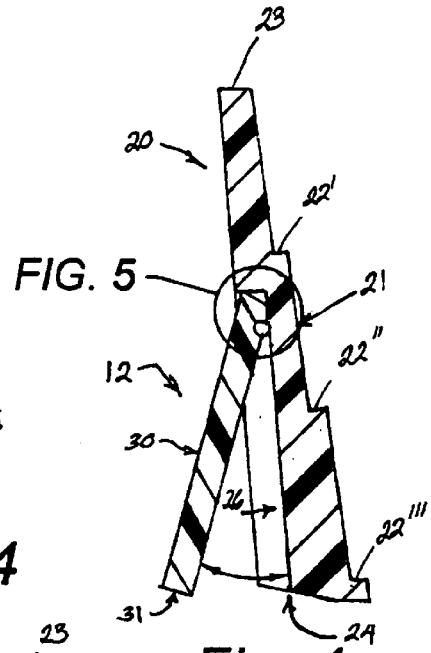
FIG. 4 is a cross-sectional view taken through line 4—4 of FIG. 2.
Figure 3:
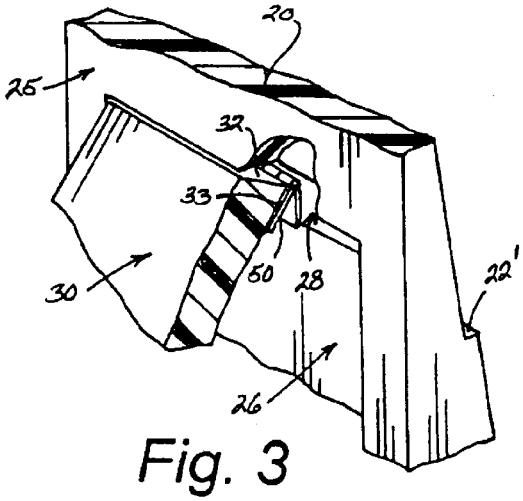
FIG. 3 is an isolated detail view of one of the hinge arrangements contemplated for use in this invention.

Turning now to FIGS. 2 through 4, it can be seen that the auxiliary support unit 12 comprises a generally flat rectangular support panel member 30 having a generally flat bottom 31 and an angled top 32 which is hingedly connected within the enlarged recess 26 in the rear face 25 of the primary support member 20.

At this juncture, it should be noted that as depicted in FIGS. 2, 4, and 6, the length of the support panel member 30 is greater than the length of the enlarged recess 26 in the rear face 25 of the primary support member 20; such that the bottom 31 of the support panel 30 projects beneath the inboard end of the rearwardly angled contoured bottom surface 24 of the primary support member 20 to allow the user to grasp and extend the support panel member 30 from within the primary support member 20 in a self-supporting picture frame fashion.

It should further be noted that in all of the various versions of the preferred embodiment, the bottom surface 24 of the primary support unit 20 is contoured and/or angled such that the primary support member 20 is inherently unstable and incapable of being self-supporting without the benefit of the added support provided by the support panel 30.

Furthermore, as can best be seen by reference to FIGS. 7 through 10, the contoured bottom surface 24 includes a generally thin flat front portion 24' and a rearwardly extending and upwardly angled rear portion 24"; wherein, the contoured bottom surface 24 can have either a generally rectangular configuration, an inwardly angled trapezoidal configuration, an inwardly flared or a generally rounded configuration. All of which are specifically designed to present a different aesthetic appearance when the display rack 10 is viewed from the side and either supported by the support panel member 30 or mounted on a vertical wall surface 100.

Figure 5:
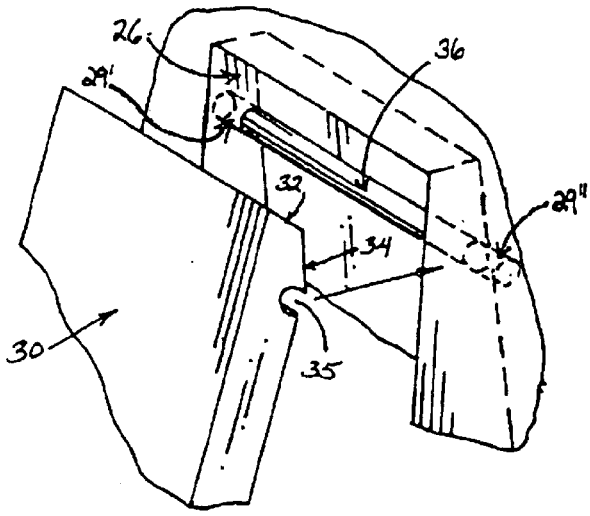
FIG. 5 is an enlarged detail view of another hinge arrangement contemplated for use in this invention.

At this juncture, it should further be noted that as depicted in FIGS. 3 through 5, the support panel member 30 is hingedly disposed within the enlarged recess 26 formed in the rear face 25 of the main support member 20; wherein, the trailing angled top surface 32 of the support panel member 30 is adapted to engage the top of the enlarged recess 26 to limit the pivotal movement of the support panel member 30 relative to the main support member 20 and to dispose the front face 21 of the main support member 20 at a desired angular orientation.

As can also be appreciated by reference to FIGS. 3 through 5, there are two distinct hinged or pivot connections contemplated for the main support member 20 and support panel member 30 which will insure that the front face of the support panel member 30 will fit in such a fashion within the enlarged recess 26 in the rear face 25 of the main support member 20 and rear face of the support panel member 30 will appear to be a continuum of the rear face 25 of the main support member 20 when the support panel member 30 is disposed in its stored position within the enlarged recess 26.

In the first version of the preferred embodiment depicted in FIG. 3, the hinge arrangement involves a conventional hinge plate 50 having one of the hinged plated leafs connectively disposed within a shallow recess 28 formed across the upper portion of the enlarged recess 26 in the rear face 25 of the main support member 20; wherein, the other hinge plate leaf is connectively disposed within a complementary recess 33 that extends across the top of the front face of the support panel member 30.

Turning now to FIGS. 4 and 5, it can be seen that in the second version of the preferred embodiment, the pivot arrangement comprises a substantially cylindrical pivot rod 36 disposed across the upper portion of the enlarged recess 26 in the primary support member 20; wherein this pivot rod 36 extends beyond and into cylindrical receptive recesses 29' and 29" in the sides of the enlarged recess 26; wherein, the upper portion 34 of the front face of the support panel member 30 is angled rearwardly to provide pivotal clearance between the back of the enlarged recess 26; wherein, the upper portion 34 of the front face of the support panel 30 is provided with an elongated semicircular recess 35 that is permanently fastened to the pivot rod 36; wherein, the permanently fastened pivot rod 36 of the support panel 30 is able to rotate within the cylindrical receptive recesses 29' and 29" and as such the support panel 30 is able to rotate within the enlarged recess 26 of the primary support member 20.

Note that many means exist as to constructing the above described second embodiment as seen in FIGS. 4 and 5, including but not limited to the following: drilling a horizontal hole along nearly the entire length of the primary support member 11 at the top of the enlarged recess 26 so as to create the cylindrical receptive recesses 29, inserting the pivot rod 36 into such hole across the enlarged recess 26, fastening the support panel member 30 with glue to said pivot rod 36, and resealing the opening of the horizontal hole; inserting a pivot rod two thirds as long as the width of the enlarged recess 26 into each cylindrical receptive recess 29, fastening these two described pivot rods together as one rod 36 with glue, then fastening the support panel member 30 with glue to said pivot rod 36; a support panel member 30 that already has the pivot rod 36 as part of it's configuration, these protruding pivot rods are slid into horizontal slots, in place of cylindrical recesses 29, and a fitting piece is fastened with glue into the top of the slots level with the back of the primary support member 11; a tri cylindrical plastic pivot rod placed into the enlarged recess 26 that can then be extended into the cylindrical receptive recesses 29 and snapped into this elongated form, and then fastening the support panel member 30 with glue to said pivot rod 36; a plastic pivot rod 36 that is longer than the enlarged recess 26 that has significant flexibility that can be inserted, slightly flexed and slid into one cylindrical receptive recess 29, and then slid across into the other cylindrical receptive recess 29 and then fastening the support panel member 30 with glue to said pivot rod 36; a support panel member 30 that already has the pivot rod 36 as part of it's configuration, that this pivot rod protrudes only slightly beyond the support panel member 30, so that, due to the flexibility of the plastic enlarged recess 26 the pivot rods 36 on the support panel member 30 can be slid and snapped into the cylindrical receptive recesses 29.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A display rack for compact discs comprising a primary support unit including a primary support member having an angled front face provided with a plurality of vertically staggered narrow depth shelves, a generally flat top, contoured bottom and a rear face provided with an enlarged recess wherein, the contoured bottom of the primary support member has a generally flat front portion and an upwardly angled contoured rear portion;

an auxiliary support unit including a support panel member dimensioned to be received in the enlarged recess in the rear face of the primary support member and, wherein, the support panel member has a generally flat bottom and an angled top having a trailing edge adapted to engage the top of said enlarged recess means for pivotally suspending the support panel member within the enlarged recess in the rear face of the primary support member.

2. The display rack as in claim 1; wherein, the length of the support panel member is greater than the length of the enlarged recess so that the bottom of the support panel member will extend beyond the bottom of the rear face of the primary support member.

3. The display rack as in claim 2; wherein, the rear face of the primary support member is further provided with a plurality of shallow mounting slots.

4. The display rack as in claim 3; wherein, the contoured rear portion of the bottom surface of the primary support surface has a generally rectangular configuration.

5. The display rack as in claim 3; wherein, the contoured rear portion of the bottom surface of the primary support surface has a generally rounded configuration.

6. The display rack as in claim 3; wherein, the contoured rear portion of the bottom surface of the primary support surface has an inwardly trapezoidal configuration.

7. The display rack as in claim 3; wherein, the contoured rear portion of the bottom surface of the primary support surface has an inwardly flared configuration.

8. The display rack as in claim 3; wherein, the means for pivotally suspending the support panel within the enlarged recess in the rear face of the primary support member comprises a conventional hinge plate having one hinge leaf connected to the support panel member and the other hinge leaf connected to the main support member.

9. The display rack as in claim 4; wherein, the means for pivotally suspending the support panel within the enlarged recess in the rear face of the primary support member comprises a conventional hinge plate having one hinge leaf connected to the support panel member and the other hinge leaf connected to the main support member.

10. The display rack as in claim 5; wherein, the means for pivotally suspending the support panel within the enlarged recess in the rear face of the primary support member comprises a conventional hinge plate having one hinge leaf connected to the support panel member and the other hinge leaf connected to the main support member.

11. The display rack as in claim 6; wherein, the means for pivotally suspending the support panel within the enlarged recess in the rear face of the primary support member comprises a conventional hinge plate having one hinge leaf connected to the support panel member and the other hinge leaf connected to the main support member.

12. The display rack as in claim 7; the means for pivotally suspending the support panel within the enlarged recess in the rear face of the primary support member comprises a conventional hinge plate having one hinge leaf connected to the support panel member and the other hinge leaf connected to the main support member.

13. The display rack as in claim 3; wherein, the means for pivotally suspending the support panel within the enlarged recess in the rear face of the primary support member comprises a generally cylindrical pivot rod attached to a selected one of the front face of the support panel member and the enlarged recess in the primary support member; and, a generally C-shaped recess formed in the other of the front face of the support panel member and the enlarged recess in the primary support member.

14. The display rack as in claim 4; wherein, the means for pivotally suspending the support panel within the enlarged recess in the rear face of the primary support member comprises a generally cylindrical pivot rod attached to a selected one of the front face of the support panel member and the enlarged recess in the primary support member; and, a generally C-shaped recess formed in the other of the front face of the support panel member and the enlarged recess in the primary support member.

15. The display rack as in claim 5; wherein, the means for pivotally suspending the support panel within the enlarged recess in the rear face of the primary support member comprises a generally cylindrical pivot rod attached to a selected one of the front face of the support panel member and the enlarged recess in the primary support member; and, a generally C-shaped recess formed in the other of the front face of the support panel member and the enlarged recess in the primary support member.

16. The display rack as in claim 6; wherein, the means for pivotally suspending the support panel within the enlarged recess in the rear face of the primary support member comprises a generally cylindrical pivot rod attached to a selected one of the front face of the support panel member and the enlarged recess in the primary support member; and, a generally C-shaped recess formed in the other of the front face of the support panel member and the enlarged recess in the primary support member.

17. The display rack as in claim 7; wherein, the means for pivotally suspending the support panel within the enlarged recess in the rear face of the primary support member comprises a generally cylindrical pivot rod attached to a selected one of the front face of the support panel member and the enlarged recess in the primary support member; and, a generally C-shaped recess formed in the other of the front face of the support panel member and the enlarged recess in the primary support member.

* * * * *